US006736263B1

(12) United States Patent
Smith

(10) Patent No.: US 6,736,263 B1
(45) Date of Patent: May 18, 2004

(54) ELASTIC COVERINGS FOR SKIS, SNOWBOARDS, AND THE LIKE

(76) Inventor: Joseph Stork Smith, 201 W. Greyhound Pass, Carmel, IN (US) 46032

( * ) Notice: Subject to any disclaimer, the term of this patent is extended or adjusted under 35 U.S.C. 154(b) by 0 days.

(21) Appl. No.: 09/527,436

(22) Filed: Mar. 16, 2000

Related U.S. Application Data

(63) Continuation-in-part of application No. 09/177,312, filed on Oct. 22, 1998.
(60) Provisional application No. 60/124,732, filed on Mar. 17, 1999.

(51) Int. Cl.[7] ..... B65D 85/20
(52) U.S. Cl. ..... 206/315.1; 53/469; 150/154; 280/815
(58) Field of Search ..... 206/315.1; 53/467, 53/469, 473; 150/154; 280/814–816; 383/118; 2/242, 239

(56) References Cited

U.S. PATENT DOCUMENTS

| | | | | |
|---|---|---|---|---|
| 3,851,689 | A | | 12/1974 | Kohls |
| 3,896,981 | A | | 7/1975 | Purple |
| 4,055,287 | A | | 10/1977 | Champenois, Jr. |
| 4,191,233 | A | | 3/1980 | McKay |
| 4,196,762 | A | | 4/1980 | Goodwin et al. |
| 4,224,693 | A | * | 9/1980 | Wehrmann et al. ..... 2/241 |
| 4,377,306 | A | | 3/1983 | Abatecola |
| 4,402,355 | A | | 9/1983 | Wymore et al. |
| 4,483,380 | A | * | 11/1984 | Beran ..... 206/315.1 |
| 4,644,986 | A | | 2/1987 | Fusaro |
| 4,674,787 | A | | 6/1987 | DeVera |
| 4,715,416 | A | | 12/1987 | Horne |
| 4,815,509 | A | | 3/1989 | Owen |
| 4,958,760 | A | | 9/1990 | Mulé et al. |
| 5,012,921 | A | | 5/1991 | Becker |
| 5,022,678 | A | | 6/1991 | Mayfield |
| 5,104,017 | A | | 4/1992 | Vandagriff |
| 5,163,550 | A | * | 11/1992 | Hawk ..... 206/315.1 |
| 5,207,323 | A | | 5/1993 | McConnell |
| 5,310,221 | A | | 5/1994 | Schmidt |
| 5,350,096 | A | | 9/1994 | Sieber |
| 5,522,592 | A | | 6/1996 | Evelsizer, Jr. |
| 5,603,122 | A | * | 2/1997 | Kania ..... 2/239 |

* cited by examiner

*Primary Examiner*—Luan K. Bui
(74) *Attorney, Agent, or Firm*—Woodard, Emhardt, Moriarty, McNett & Henry LLP

(57) ABSTRACT

The present invention generally relates to elastic coverings for an alpine sport equipment, specifically, skis, snowboards and the like. In a preferred embodiment, the elastic covering is made from a stretchable, washable, water-permeable, elastic material and is formed into an elongated tube, similar in configuration to a sock. The piece of alpine sport equipment is inserted into the elastic covering, which stretches to fit snuggly over the equipment. The length of the covering, in conjunction with its elastic nature, allow the elastic covering to completely cover alpine sport equipment having a widely varying length. The open end of the elastic covering includes integral straps for tying the end closed after the sporting equipment has been placed therein. The elastic covering is preferably formed from material having a lower coefficient of friction on one side than the other, such that the low coefficient of friction side is oriented toward the interior of the covering. This low friction surface allows the elastic covering to easily be drawn over the sport equipment notwithstanding its tight fit.

14 Claims, 9 Drawing Sheets

ELASTIC COVERINGS FOR SKIS, SNOWBOARDS, AND THE LIKE

The present application claims the benefit of the filing date of provisional application, Serial No. 60/124,732, filed Mar. 17, 1999, entitled ELASTIC COVERINGS FOR SKIS, SNOWBOARD, AND THE LIKE. The present application is a continuation-in-part of an utility application, Ser. No. 09/177,312 filed Oct. 22, 1998, entitled ELASTIC SKI COVERING HAVING REMOVABLE FASTENERS. The referenced applications are incorporated herein by reference in their entirety.

TECHNICAL FIELD OF THE INVENTION

The present invention generally relates to sporting equipment and, more particularly, to elastic coverings for skis, snowboards, and the like.

BACKGROUND OF THE INVENTION

Snow skiing is very popular in the United States and throughout the world. Similarly, snowboarding has seen a tremendous rise in popularity over the last few years. Since most people do not live at the location where the terrain and weather are conducive for such activities, participants of these sports usually have to travel to a ski resort in order to engage in these sports, which also necessitates the transport of their sporting equipment to the resorts. Furthermore, the participants still have to carry their equipment to and from the ski slopes.

Snow skis are high performance articles of sporting equipment and are therefore usually relatively expensive. Furthermore, snow skis are also somewhat delicate, especially with regard to keeping their various surfaces and edges in optimal condition for skiing. It is therefore essential that the skis be protected from physical harm while they are being transported. But, because of their awkward lengths, shape, and cutting edges, protecting the skis during transit prove to be a challenge.

Ski bags of various designs are known in the art. For example, U.S. Pat. No. 4,196,762 to Goodwin et al. discloses a bag for transporting skis, ski poles and the like. The bag is formed from a matching pair of side panels of indoor-outdoor carpet material and a strip of nylon edge reinforcing tape stitched together along two sides and one end of the side panels. The bags also includes a nylon wrapping handle to facilitate carrying and a metal ring to permit hanging the bag for drying or storage. U.S. Pat. No. 4,402,355 to Wymore et al. discloses a protective container for snow skis having an elongated body with inner and outer wall members fabricated of a pliable material. The wall members are retained in spaced-apart relationship by a resiliently deformable cushion member placed thereinbetween, with the inner wall defining a compartment for receipt of a set of snow skis. On the whole, ski bags such as those described above are bulky and heavy. As a result, they cannot conveniently be carried by a skier while skiing and a safe place must be found for storing the ski covers or bags when not in use.

Smaller and relatively lightweight devices for transporting a pair of skis are also known in the art. For example, U.S. Pat. No. 5,022,678 to Mayfield discloses a ski sleeve, which is designed to fit over the tip of a ski at either end. The ski sleeves have integral hook and loop fasteners which may be used to secure the ski sleeve to the ski. This design, however, fits over only a single ski and leaves the bulk of that ski, as well as the other ski in the pair, completely unprotected. U.S. Pat. No. 4,055,287 to Champenois, Jr. discloses a protective covering for a snow ski binding which includes a weatherproof sheet that is wrapped around the bindings of a pair of skis and then secured thereto by means of an integral hook and loop fastener. This design also leaves a large expanse of the skis completely unprotected. U.S. Pat. No. 3,851,689 to Kohls discloses a foldable ski cover including an elongated bag having two compartments for receiving an individual ski in each compartment. The bag is made from a flexible, waterproof material and includes several reclosable fasteners attached thereto. This waterproof material will tend to trap dirt and debris therein after use with dirty skis, wherein such debris can only be removed with difficulty. Furthermore, skis are manufactured and sold in widely varying lengths, and the positioning of the fasteners on this prior art bag may be awkward when used with certain ski lengths. U.S. Pat. No. 5,207,323 to McConnell discloses a ski sock which is made from a stretchable material and configured to receive a pair of skis. Additionally, the sock includes an elastic band for closure at an inlet end, a closed opposite end, and handles and straps for carrying the skis together. The ski sock fits snugly about and completely covers both skis. The interior surface of this sock is coated with a dry, slick-film to facilitate insertions and removal of skis from the ski sock. The slick surface, being an applied coating, is subjected to wear and will have to be re-applied in order to maintain its slickness.

Like skis, snowboards are expensive, high performance articles of sporting equipment, and it is essential that the snowboard be protected from physical harm while it is being transported. The inventor is unaware of any prior art designs for protecting snowboards while they are being transported. Additionally, because of their width, snowboards are usually carried up the ski slope by snowboarders holding the edge of the snowboard under their arms with their gloved hands. On many occasions, the sharp edges of the snowboard cut into the gloves, damaging the gloves and dulling the edge of the snowboard in the process.

It is therefore an object of the present invention to provide flexible lightweight bags for the transportation of equipment for snow skiing and snowboarding, which completely enclose the equipment being transported in order to prevent damage to the equipment, and in turn prevent the sharp edge of the equipment from damaging surrounding articles.

It is another object of the present invention to provide a protective covering for alpine sport equipment, e.g., skis and snowboard, that is durable, and capable of localizing the damage if it is damaged.

It is still another object of the present invention to provide coverings for alpine sports equipment which are made from a material having a low coefficient of friction, thus enabling the covering to slide easily over the equipment during placement.

It is yet another object of the present invention to provide a covering for alpine sports equipment from which dirt and debris may easily be removed after each use.

Other objects and advantages of the present invention will become apparent from the following written description and appended claims taken in conjunction with the accompanying drawings.

SUMMARY OF THE INVENTION

The present invention generally relates to protective coverings having removable fasteners for alpine sports equipment, in particular, snow skis and snowboards and the like. The protective covering is made from a flexible, stretchable, elastic, washable, and water-permeable fabric. This fabric has a low coefficient of friction on at least one surface and is oriented that the low coefficient of friction surface faces into the interior of the protective coverings. This low friction surface allows the elastic covering to easily be drawn over the snowboard notwithstanding its tight fit. Generally, the protective covering is formed into an elongated tube, similar in configuration to a sock, and is available in different sizes to accommodate either skis or snowboards (sporting equipment). The sporting equipment is inserted into its appropriate protective covering, which stretches to fit snuggly over the sporting equipment and its associated bindings. The length of the protective covering, in conjunction with its elastic nature, allow the protective covering to completely cover the sporting equipment having varying lengths. The open end of the protective covering includes integral straps for tying the end closed after the sporting equipment has been placed therein. Removable fasteners are provided and are placed on strategic locations along the protective covering and securely affix the protective covering to the sporting equipment.

In one form of the invention, a protective covering for skis, snowboards and the like is disclosed, comprising a protective covering for alpine sport equipment, comprising a first elongated material piece formed from a flexible, elastic, water-permeable fabric, the fabric has a low coefficient of friction on at least one surface, a second elongated material piece formed from the fabric, wherein the first and second material pieces are coupled together along three respective sides, thereby forming an opening at a fourth side and defining a cavity; and wherein the surface having a low coefficient of friction faces into the cavity.

In another form of the invention, a ski covering is disclosed, comprising an elongated bag having an opening and an inside surface defining an interior cavity, the bag formed from a flexible, elastic, water-permeable fabric, the fabric having a low coefficient of friction on both first and second surfaces, the first surface having a lower coefficient of friction than the second surface and oriented with the lower coefficient of friction surface forming the inside surface of the interior cavity; the interior cavity is adapted to receive a pair of skis.

In another form of the invention, a snowboard covering is disclosed, comprising an elongated bag having an opening and an inside surface defining an interior cavity, the bag formed from a flexible, elastic, water-permeable fabric, the fabric having a low coefficient of friction on both first and second surfaces, the first surface having a lower coefficient of friction than the second surface and oriented with the lower coefficient of friction surface forming the inside surface of the interior cavity; the interior cavity is adapted to receive a snowboard.

In another form of the invention, a method of covering a snowboard having bindings thereon is disclosed, comprising the steps of: a) providing an elongated bag having an opening, means for closing the opening, an inside surface defining an interior cavity, the bag formed from a flexible, elastic, water-permeable fabric, the fabric having a low coefficient of friction on both first and second surfaces, the first surface having a lower coefficient of friction than the second surface and oriented with the lower coefficient of friction surface forming the inside surface of the interior cavity, the interior cavity is adapted to receive a snow board; b) standing the snowboard on one end; c) inserting the snowboard into the bag through the opening; d) pulling the bag down over the snowboard through the opening into the interior cavity such that the snowboard are completely enclosed therein; e) closing the means for closing; f) providing one removable fastener adapted to removably enclose the snowboard against the bag near the opening; and g) applying the one removable fastener around the bag and the snowboard such that the excess lengths of bag are firmly held and not free to flap during transport.

In another form of the invention, a method of covering a pair of skis having bindings thereon is disclosed, comprising the steps of: a) providing an elongated bag having an opening, means for closing the opening and an inside surface defining an interior cavity, the bag formed from a flexible, elastic, water-permeable fabric, the fabric having a low coefficient of friction on both first and second surfaces, the first surface having a lower coefficient of friction than the second surface and oriented with the lower coefficient of friction surface forming the inside surface of the interior cavity; the interior cavity is adapted to receive a snow board; b) standing the pair of skis on end; c) inserting the skis into the bag through the opening; d) pulling the bag down over the skis through the opening into the interior cavity such that the skis are completely enclosed therein; e) closing the means for closing; f) providing at least one removable fastener adapted to removably enclose the skis; and g) applying the at least one removable fastener around the bag and the skis such that the skis are firmly held in contact with one another.

DETAILED DESCRIPTION OF THE PREFERRED EMBODIMENTS

Figure 1:
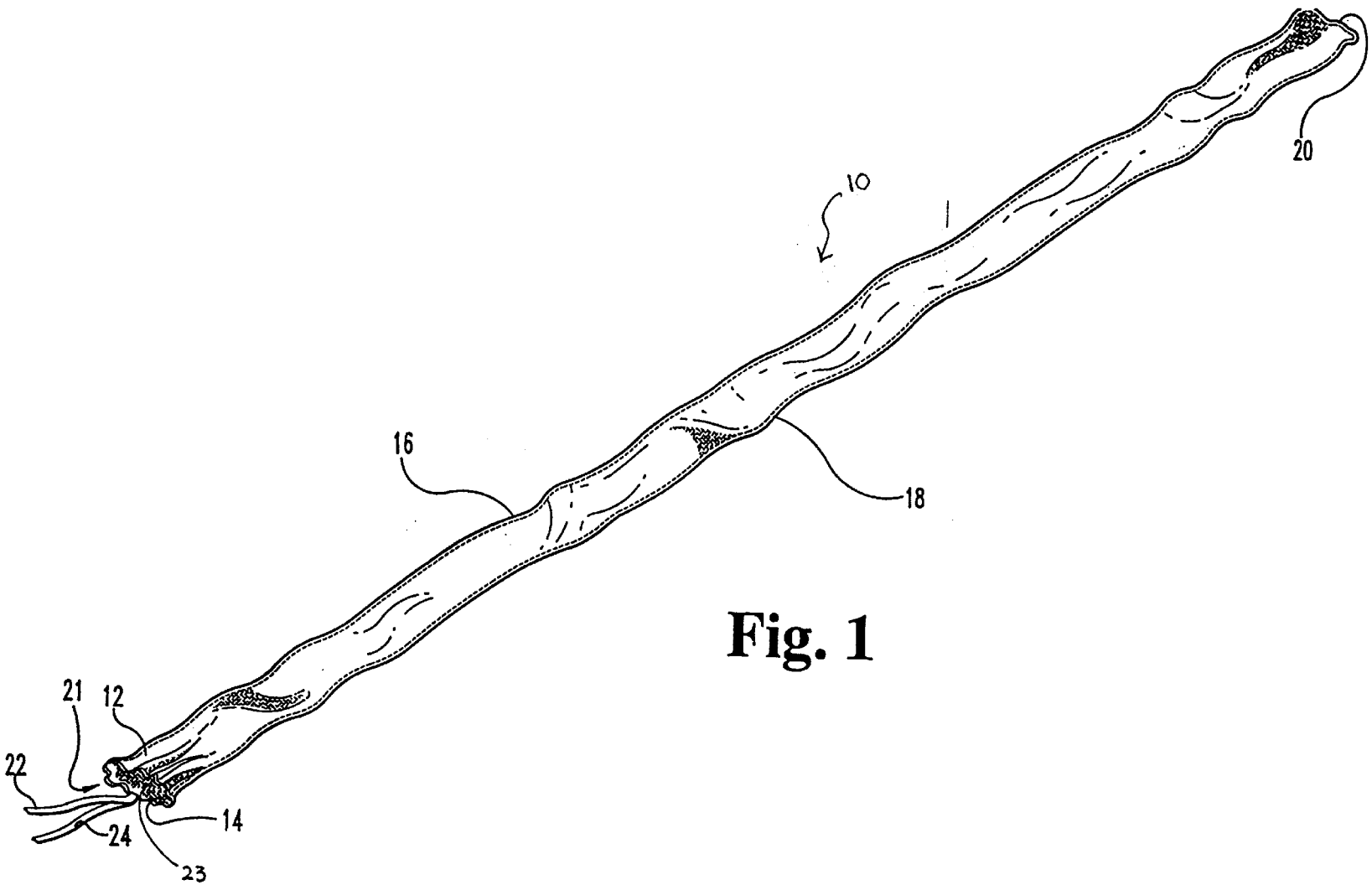
FIG. 1 is a perspective view of the first embodiment of an elastic ski covering of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates are also included.

The first embodiment of the present invention comprises three components, namely an elastic ski covering and a pair of removable fasteners for use therewith. A first embodiment of the elastic covering or protective covering of the present invention is illustrated in FIG. 1, and indicated generally at 10. The ski covering 10 is designed to cover any length skis up to at least about seven feet long using a single-size ski covering 10. The ski covering 10 is preferably formed from a first piece of material 12 and a second piece of material 14, each having an elongated rectangular configuration approximately eight feet long and four inches wide, although shorter or longer material pieces will also work. The first material piece 12 is preferably sewn to the second material piece 14 along three edges, thereby forming seams 16, 18 and 20. The fourth side of the material pieces 12, 14 is left open, thereby defining an opening 21 into an interior cavity 23. The ski covering 10 is therefore formed as an elongated rectangular bag having an opening on one of the small sides.

In the first embodiment of the elastic ski covering, the first material piece 12 and second material piece 14 are formed from a flexible, stretchable, elastic material, such as an elasticized nylon weave. Alternative materials are also contemplated for construction of the first material piece 12 and second material piece 14. For example, natural fibers such as cotton or wool may be used. It is desirable that the chosen material construction be washable and water-permeable, so that the ski covering 10 may be washed after use in order to remove any debris which may have become lodged therein, for example, after stretching the ski covering 10 over a dirty pair of skis. In an alternative embodiment, the ski covering 10 may be formed from a continuously woven tube, such as those used in the manufacture of socks, having the same approximate dimensions described hereinabove. In this alternative embodiment, the seams 16 and 18 (and possibly the seam 20) will not be required.

Figure 3:
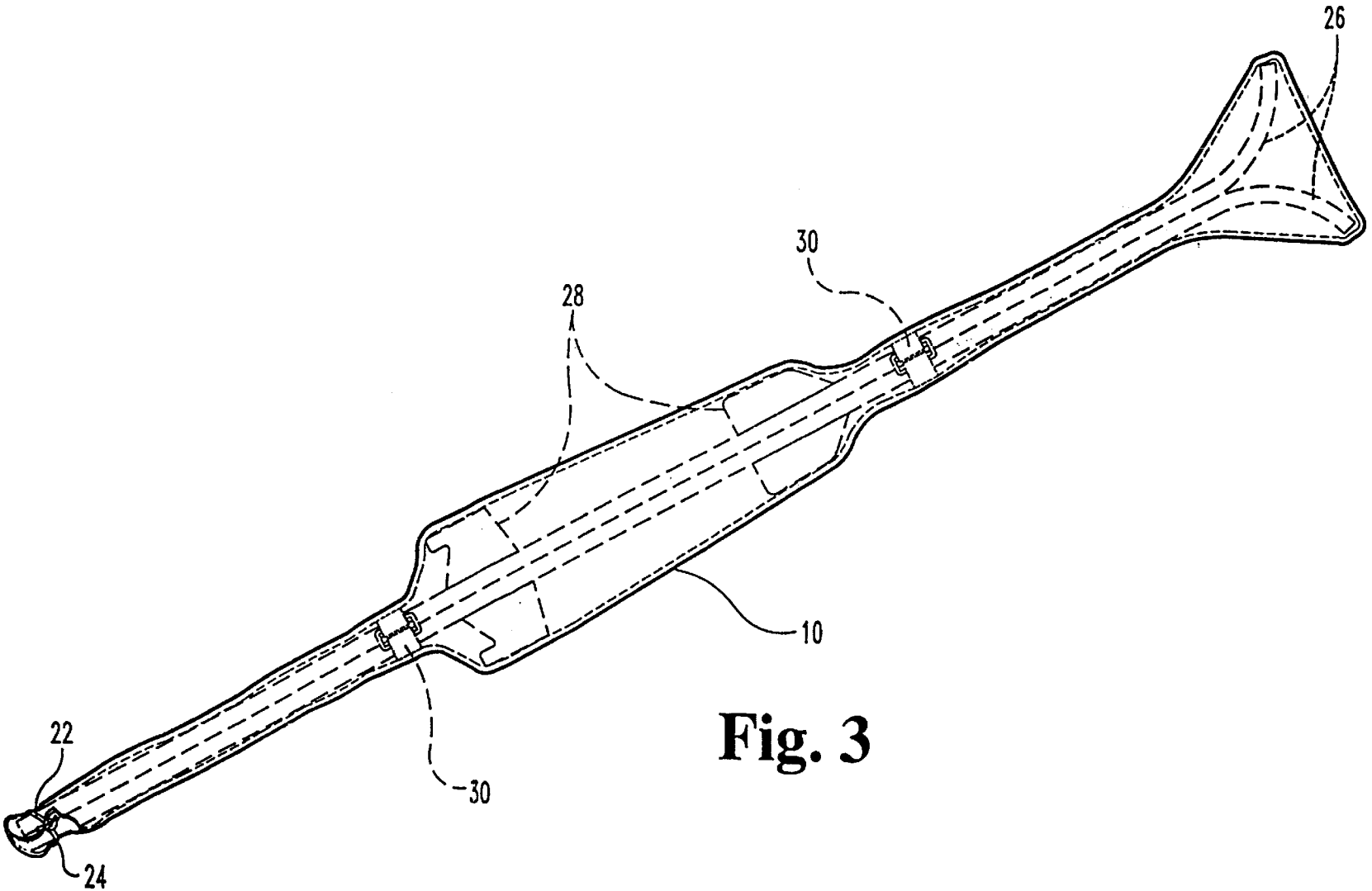
FIG. 3 is a side elevational view of the first embodiment of a ski covering and removable fasteners installed upon a pair of skis.

When configured as described hereinabove, the ski covering 10 may be slid over a pair of skis positioned bottom-to-bottom by placing the open end 21 over the tips of the skis and pulling the ski covering to the other end of the skis, until the tips of the skis are located at the seam 20. As shown in FIG. 3, the stretchable, elastic nature of the fabric pieces 12, 14 allows the ski covering 10 to generally conform to the shape of the skis 26 and bindings 28. Because the length of the ski covering 10 is longer than the skis 26 which it is designed to cover, a pair of end closure straps 22, 24 are sewn to the second material piece 14 near the opening 21. The end closure straps 22, 24 are preferably formed from a woven nylon or other strong material. The excess portion of the material pieces 12, 14 which extend beyond the end of the skis 26 is folded over upon itself and the end closure straps 22, 24 are wrapped therearound and tied into a knot. The end closure straps 22, 24 therefore prevent the skis 26 from exiting the opening 21 while the skis 26 are contained within the ski covering 10.

It will be appreciated by those skilled in that art that any conventional means for closing the opening 21 may be used in place of the end closure straps 22, 24. For example, and not by way of limitation, the opening 21 may be closed using a zipper, a drawstring, a hook-and-loop closure, snaps, buttons, or any other conventional means for closing known in the art.

Figure 2:
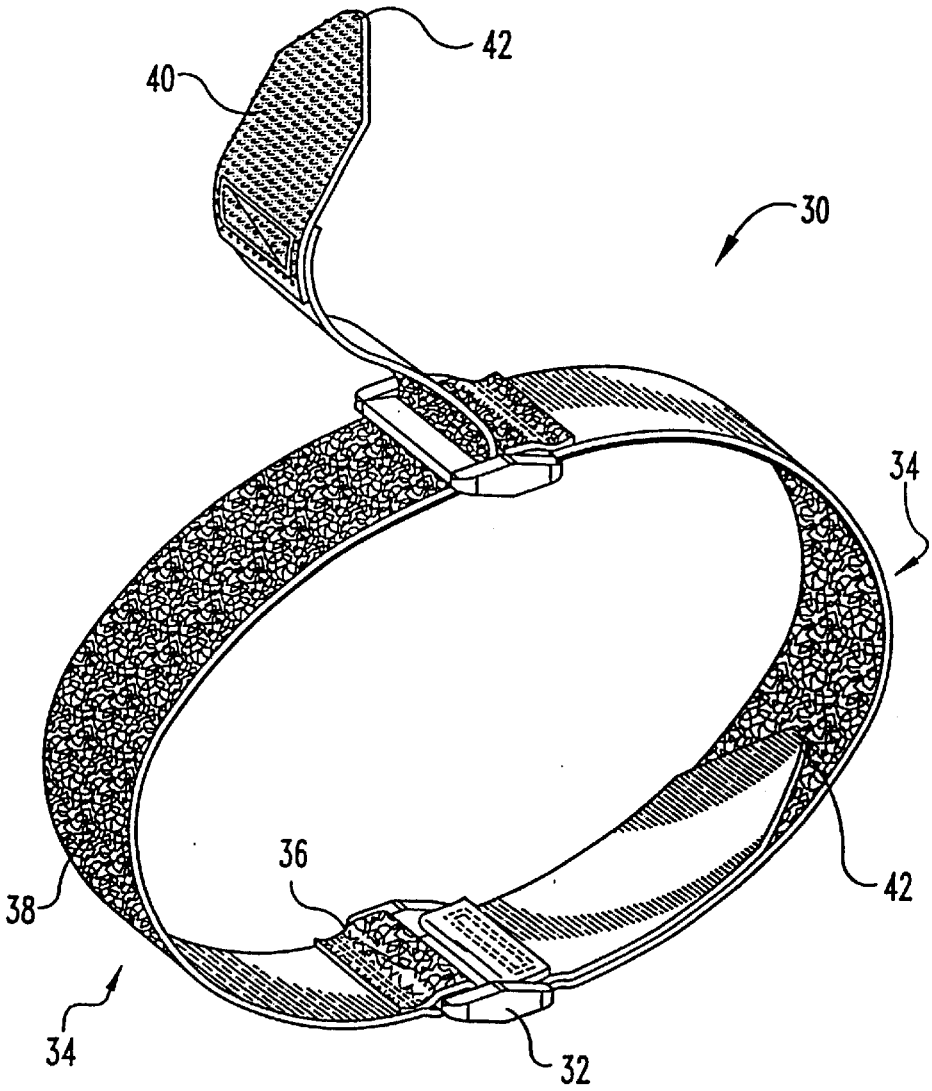
FIG. 2 is a perspective view of the first embodiment of a removable fastener of the present invention.

As can be seen with reference to FIG. 3, the ski covering 10 of the present invention, because of its length and elastic nature, is able to completely cover and conform to fit skis 26 having any length and any size bindings 28. A single size configuration for the ski covering 10 therefore suffices to provide what appears to be a custom fit for any size ski 26/binding 28 combination. In order to maintain these skis 26 in their bottom-to-bottom configuration, and to more closely conform the ski covering 10 to the contours of the skis 26/bindings 28, a pair of removable fasteners are preferably provided as illustrated in FIG. 2 and indicated generally as 30. The removable fasteners 30 may be of any type which allow the fasteners 30 to hold the ski covering 10 and skis 26 firmly together at any point along their length, such that the fastener 30 is removable from the ski covering 10 in order to allow it to be placed at a different position along the length of the skis 26. In the first embodiment illustrated in FIG. 2, the removable fastener 30 comprises two rectangular plastic buckles 32 and two closure straps 34. The first end 36 of each closure strap 34 is wrapped around one side of one of the buckles 32 and sewn to itself in order to form a permanent connection to the respective buckle 32, as shown. Each of the straps 34 is preferably formed from an elastic woven nylon webbing or other strong material and includes a first portion 38 covered with loop pile material and a second portion 40 covered with hook material, thereby forming a hook-and-loop fastener pair. A second end 42 of each closure strap 34 may then be threaded through the remaining half of the opposite buckle 32 and closed by engaging the hook material 40 with the loop pile material 38 at a desired location. As illustrated in FIG. 2, this arrangement provides for a removable fastener 30 which may be placed around objects having widely varying sizes and adjusted so as to tightly conform to these objects.

The first embodiment of removable fastener 30 is therefore ideally suited for use with the ski covering 10 of the present invention. As illustrated in FIG. 3, removable fasteners 30 are placed directly around the skis 26 at a location on either side of the bindings 28. Alternatively, the removable fasteners 30 may be placed over the exterior of ski covering 10, if desired. The removable fastener 30 may then be adjusted to a size that securely holds the ski covering 10 and skis 26 together, at which point the removable fastener 30 may be closed by engaging the hook material 40 to the loop pile material 38. Once engaged on either side of the bindings 28, the removable fasteners 30 function to maintain the skis 26 in a bottom-to-bottom configuration. Additionally, placement of the removable fasteners 30 over the exterior of the ski covering 10 will also limit movement of the skis 26/bindings 28 within the ski covering 10, reducing any detrimental rubbing between the ski covering 10 and the skis 26 and will also prevent the skis 26 from sliding down and applying pressure upon the knot tied with the end closure straps 22, 24 and possibly forcing this knot open. Because the fasteners 30 are completely removable from the skis 26 and the ski covering 10, they may be placed at any point along the length thereof, greatly facilitating the use of the ski covering 10 with bindings 28 of widely varying dimensions and allowing the fasteners 30 to be placed as close as desirable to the bindings 28. The ski covering 10 and removable fasteners 30 of the present invention therefore provide a ski covering that may be custom fit to any ski 26/binding 28 combination. The stretchable elastic fabric of the ski covering 10 will conform to the contours of the skis 26/bindings 28, the end closure straps 22, 24 may be tied off at the end of any length ski 26, and the removable fasteners 30 may be used to tightly couple the whole combination together on either side of the bindings 28. The washable, water permeable weave of the material 12, 14 allows the ski covering 10 to be washed after use and any debris lodged therein completely removed prior to the next use of the ski covering 10. The ski covering of the present invention therefore represents a significant improvement over the prior art devices.

Figure 4:
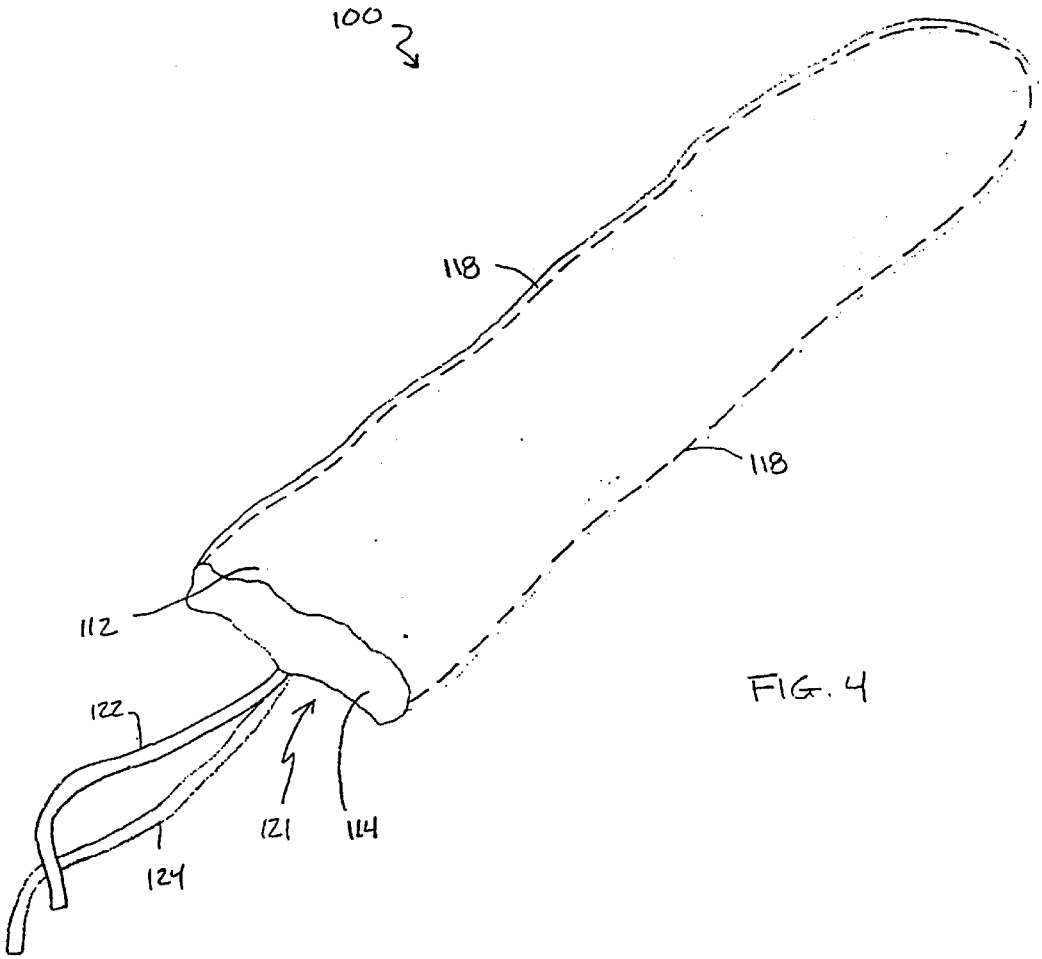
FIG. 4 is a perspective view of the second embodiment of a snowboard covering of the present invention.

In a second embodiment of the present invention, an elastic covering is provided for use with a snowboard. The second embodiment of the elastic covering of the present invention is illustrated in FIG. 4, and indicated generally at 100. The snowboard covering 100 is preferably formed from a first piece of material 112 and a second piece of material 114, each having an elongated rectangular configuration with one end being rounded in order to conform to the rounded end of the snowboard to be placed therein. The first piece of material 112 is preferably sewn to the second piece of material 114 along its edges, thereby forming the continuous seam 118. The fourth side of the material, pieces 112, 114 is left open, thereby defining an opening 121 into an interior cavity. The snowboard covering 100 is therefore formed as an elongated bag having an opening on one end thereof.

In the second embodiment, the first material piece 112 and the second material piece 114 are formed from a flexible, stretchable, elastic material. The elastic nature of the material will force the snowboard covering 100 to conform to the contours of the snowboard and its associated bindings. Because of the snug fit of the snowboard cover 100, friction between the snowboard covering 100 and the snowboard over which it is installed could make such installation cumbersome and frustrating. In a preferred form of the second embodiment of the present invention, therefore, it is contemplated that the material pieces 112 and 114 be formed from a material which has a lower coefficient of friction on one side thereof than on the reverse side thereof. The side of each material piece 112, 114 having the lower coefficient of friction is oriented toward the interior of the snowboard bag 100. This forms an interior cavity within the snowboard bag 100 that is lined with a low coefficient of friction material, thereby facilitating installation of the elastic snowboard covering 100 over the snowboard. Removal of the snowboard covering 100 is similarly expedited.

It is desirable that the material construction chosen be washable and water-permeable, so that the snowboard covering 100 may be washed after use in order to remove any debris which may have become lodged therein after stretching the snowboard covering 100 over a dirty snowboard. In an alternative embodiment, the snowboard covering 100 may be formed from a continuously woven tube, such as those used in the manufacturer of socks. In this alternative embodiment, the seam 118 will be eliminated. The snowboard covering 100 further includes end closure straps 122 and 124 which are analogous to the straps 22, 24 described hereinabove. The straps 122, 124 operate in the same manner in order to close off the opening 121 after a snowboard has been placed within the snowboard covering 100. It will be appreciated by those skilled in the art that any conventional means for closing the opening 121 may be used in place of the end closure straps 122, 124. For example, and not by way of limitation, the opening 121 may be closed using a zipper, a drawstring, a hook-and-loop closure, snaps, buttons, or any other conventional means for closing known in the art.

Figure 5:
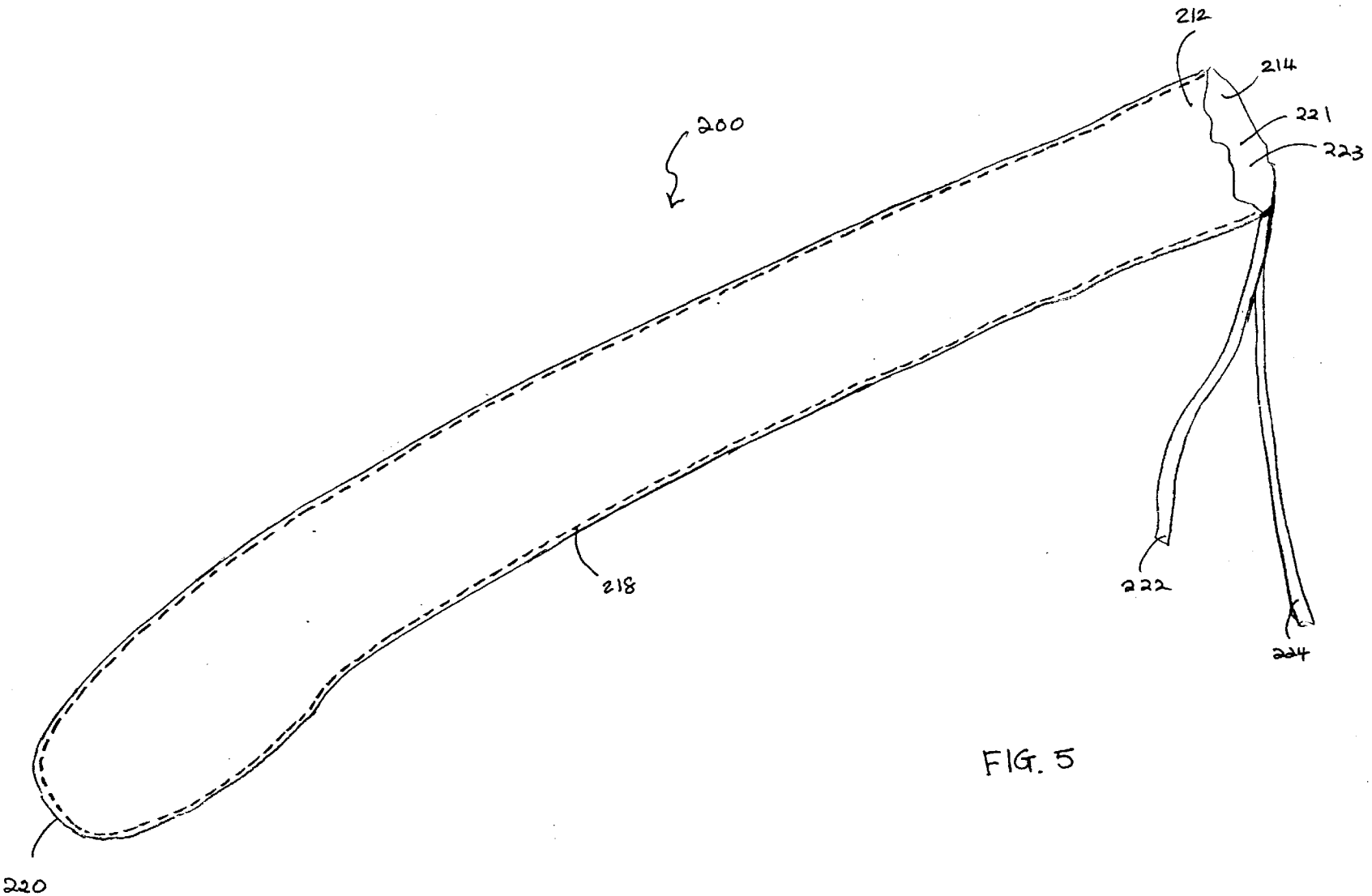
FIG. 5 is a perspective view of the second version of the second embodiment of a snowboard covering of the present invention.

In a preferred second embodiment of the present invention, an improved elastic covering or snowboard bag is provided for use with a snowboard. This embodiment includes two components, namely an elastic snowboard covering 200 and one removable fastener 230 for use therewith. The elastic snowboard covering 200 is illustrated in FIG. 5, and indicated generally at 100. The snowboard protective covering or bag 200 is approximately 70 inches long and 12 inches wide designed for covering any snowboard up to at least about five and a half feet long. While the sizes of the snowboard covering 200 are indicated in the illustrated embodiment, it is contemplated that the snowboard covering 200 may be larger to accommodate snowboards of larger dimensions.

The snowboard protective covering 200 is formed from a fabric which is lightweight, flexible, stretchable and elastic. It is preferable that the fabric is stretchable at least 100% lengthwise and 50% widthwise. It is more preferred that the fabric is stretchable greater than approximately 190% lengthwise and approximately 100% widthwise. Additionally, the fabric possesses a low coefficient of friction which is inherent of the fibers from which the fabric is woven. Preferably, one side or surface of the fabric has a lower coefficient of friction than its opposing second side or surface. Furthermore, the fabric is woven in such way that the stitching will not run when the fabric is damaged, even punctured, so that a localized damage will not spread. It is also desirable that the fabric is water-permeable and washable. The fabric of construction of the illustrated embodiment is an elasticized nylon fabric, specifically, a blend of nylon and Lycra® spandex, and more specifically, a blend of 82% nylon and 18% Lycra® spandex. An example of the nylon and spandex blend is a matte tricot, style #55882, a product of Guilford Mills. This material has a stretchability of approximately 200% lengthwise and 144% widthwise. Additionally, this fabric has viscosity measurements of 9 on one surface and 23 on the second surface. Viscosity is a measurement of the resistance the fabric generates as it passes through water. The lower the number, the lesser the resistance. Hence, viscosity measurements are indicative of "slickness" or the coefficient of friction of a fabric against other media. While an elasticized nylon has been chosen as the material of construction for the illustrated embodiment, it will be readily apparent to those skilled in the art that other fabrics having the desired stretchability, elasticity, coefficient of friction and washability may be utilized without deviating from the spirit, scope and content of the present invention.

The snowboard bag 200 is preferably formed from a first piece of material 212 and a second piece of material 214, each having an elongated rectangular configuration with one end being rounded in order to conform to the rounded end of the snowboard to be placed therein. First piece of material 212 is matched to second piece of material 214 having the surfaces with lower coefficient of friction oriented towards the inside of the snowboard bag 200. The first piece of material 212 is preferably sewn to second piece of material 214 along its edges, thereby forming the continuous seam 218. The fourth side of material pieces 212 and 214, is left open, thereby defining an opening 221 into an interior cavity or pocket 223. The snowboard protective covering 200 is therefore formed as an elongated bag having an opening on one end thereof. In an alternative embodiment, snowboard covering 200 may be formed from a continuously woven tube, such as those used in the manufacturer of socks. In this alternative embodiment, seam 218 will only formed on the rounded end 220. The snowboard covering 200 further includes tie end closure straps 222 and 224 which are analogous to the straps 22, 24 described hereinabove, except that the end closure straps 222 and 224 are sewn along seam 218. The straps 222, 224 operate in the same manner in order to close off the opening 221 after a snowboard 226 has been placed within the snowboard covering 200. It will be appreciated by those skilled in the art that any conventional means for closing the opening 221 may be used in place of the end closure straps 222, 224. For example, and not by way of limitation, the opening 221 may be closed using a zipper, a drawstring, a hook-and-loop closure, snaps, buttons, or any other conventional means for closing known in the art.

Figure 6:
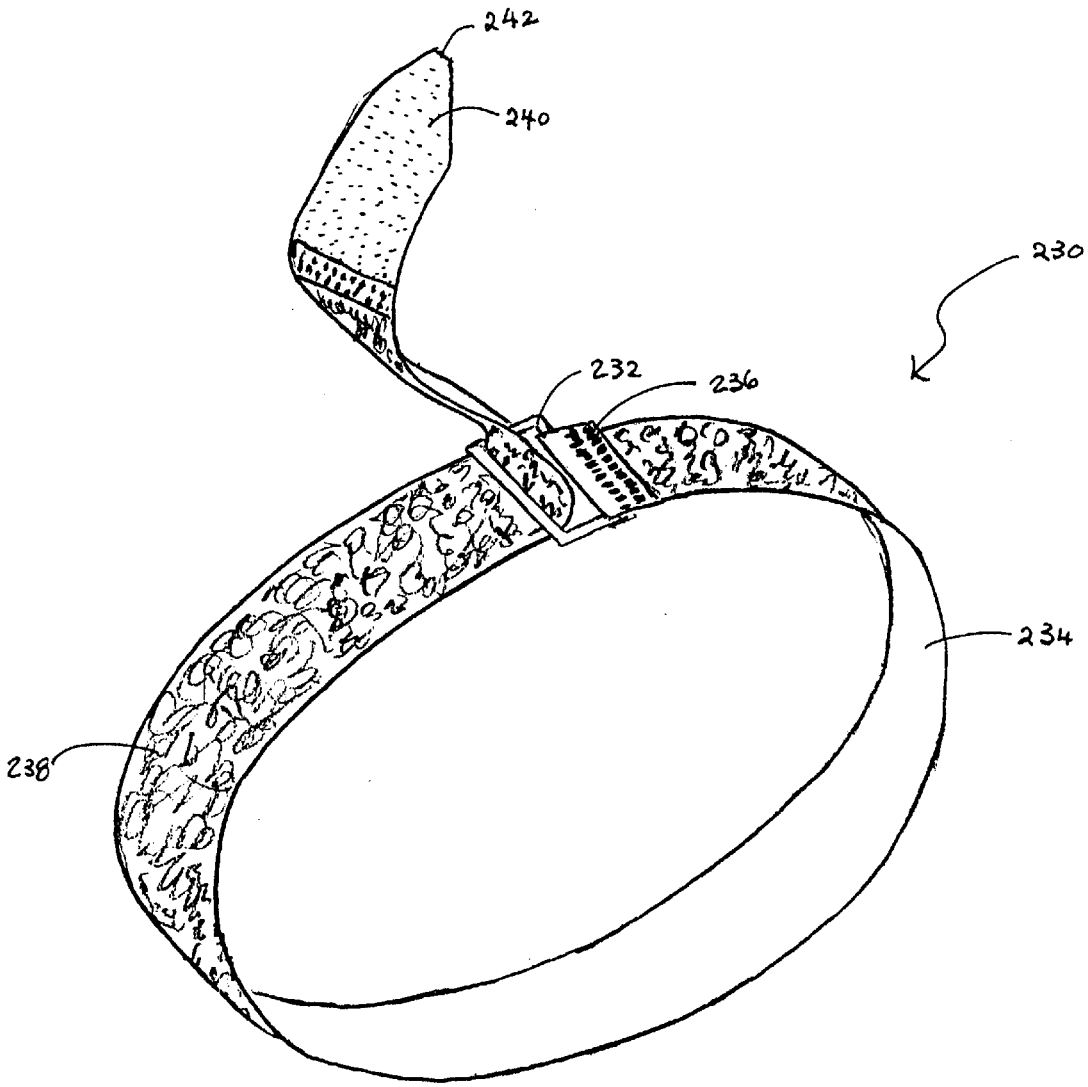
FIG. 6 is a perspective view of the second embodiment of a removable fastener of the present invention.

The second component of this illustrated and preferred second embodiment of the present invention is removable fastener 230. As shown in FIG. 6, fastener 230 is a simpler version of fastener 30 (FIG. 2) discussed hereinabove. Removal fastener 230 is adapted to wrap around a snowboard, and is approximately 29 inches long. Other lengths are within the contemplation of the present invention. Removable fastener 230 includes a buckle 232 and a closure strap 234. Buckle 232 is preferable formed of plastic; however, other strong and lightweight materials may be used. Closure straps 234 includes first end 236 and second end 242, and a first portion 238 covered with loop pile material and a second portion 240 covered with hook material. The first end 236 is permanently connected to buckle 232. The second end 242 is free and may be threaded through buckle 232 and closed by engaging the hook material 240 with the loop pile material 238 at a desired location. Closure strap 234 is preferably formed from an elastic woven nylon webbing or other strong materials.

Figure 7:
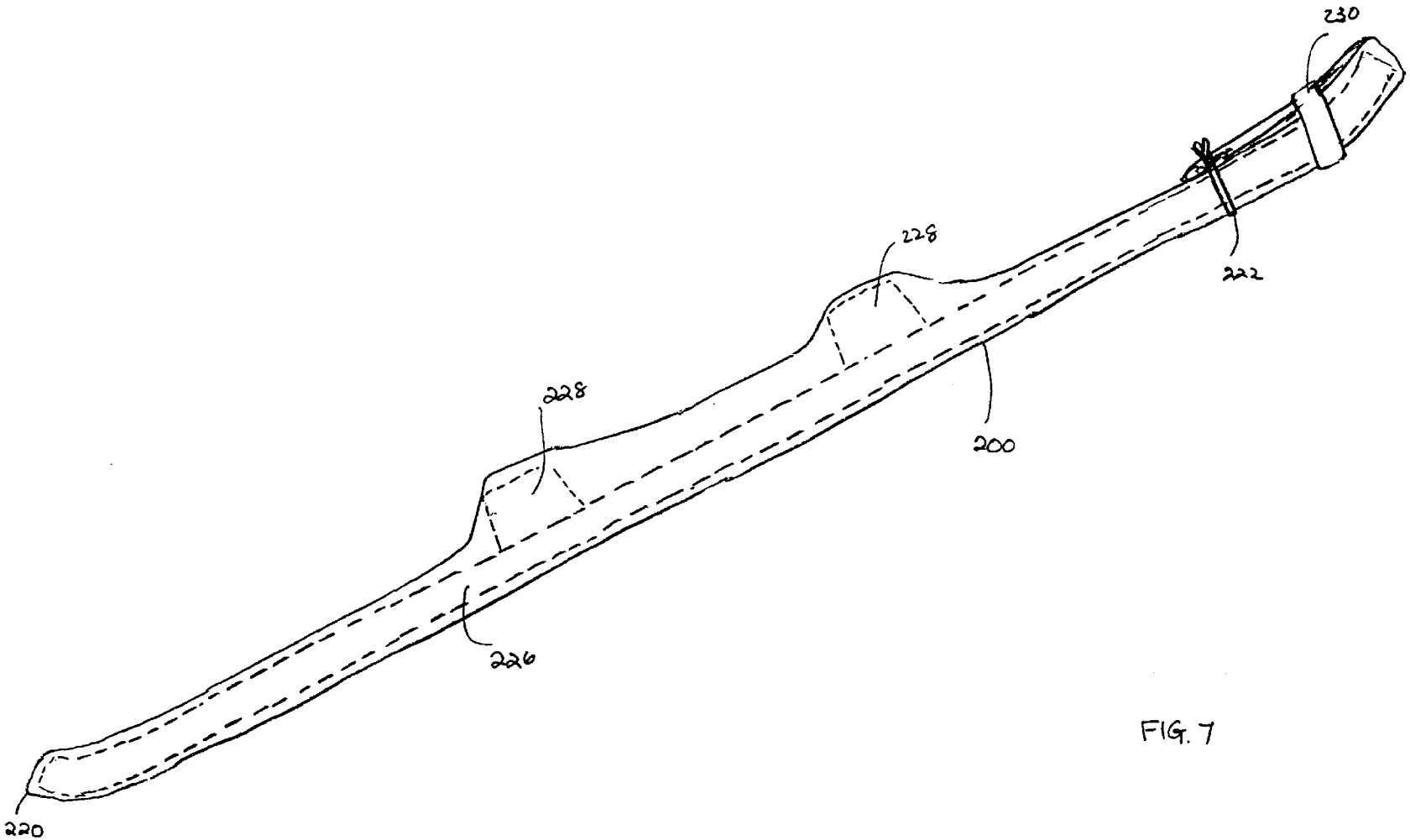
FIG. 7 is a side elevation view of the second version of the second embodiment of a snowboard covering and removable fastener installed on the outside of a snowboard covering having a snowboard placed therein.

When configured as described hereinabove, the snowboard covering 200 may be slid over a snowboard 226 by placing the open end 221 over the tip of the snowboard and pulling the snowboard covering 200 to the other end of the snowboard, until the tip of the snowboard is located at the rounded end 220. The elastic nature of the material will force the snowboard covering 200 to conform smoothly to the contours of the snowboard 226 and its associated bindings 228. The snug fit of the snowboard cover 200 over the snowboard could have made such installation cumbersome and frustrating. However, the low coefficient of friction surface lining of the interior cavity 238 enables snowboard bag 200 to slide over the snowboard notwithstanding the tight fit. Continuous seam 218 also provides a handy grip for drawing snowboard bag 200 over the snowboard 226. Removal of the snowboard covering 200 is similarly expedited. After a snowboard 226 is received in the snowboard covering 200, excess covering which extends beyond the end of snowboard 226 is folded a few times over one of the closure straps 222 or 224 and then the two closure straps 222 and 224 are wrapped therearound and tied into a knot. The end closure straps 222, 224 therefore prevent the snowboard from exiting the opening 221 while the snowboard 226 is contained within the snowboard covering 200. The excess fabric flap is further restrained by removable fastener 230 as shown in FIG. 7.

So enclosed, snowboard 226 may be transported on a car top or inside a ski bag or in the trunk of a vehicle. When transported outside, the protective cover 200 protects snowboard 226 from road grime or being exposed to the elements of the weather. Additionally, protective cover 200 protects the vehicle from being inadvertently scratched by the sharp edges of snowboard 226 while loading. When transported inside a bag or in the trunk of a vehicle, protective covering 200 shields snowboard 226 and hence protects both snowboard 226 and the articles packed around snowboard 226 from damaging each other. Upon arrival at a ski resort, snowboard 226 may be unloaded and carried directly up the slope. Protective covering 200 continues to shield snowboard 226 from cutting into the gloves and hands of the person carrying snowboard 226. Before use, protective covering 230 is removed and rolled and tied into a bundle by removable fastener 230. Due to its small size, snowboard covering 200 can be carried inside the jacket of the snowboarder and later placed back on snowboard 200 for transport back to the ski resort. Snowboard covering 200 may be washed after use to remove any debris which may have become lodged therein after stretching snowboard covering 200 over a dirty snowboard. Repeated washing will not harm or reduce the slickness of the inside surface since the low coefficient of friction condition is an inherent property of the fabric of construction.

Figure 8:
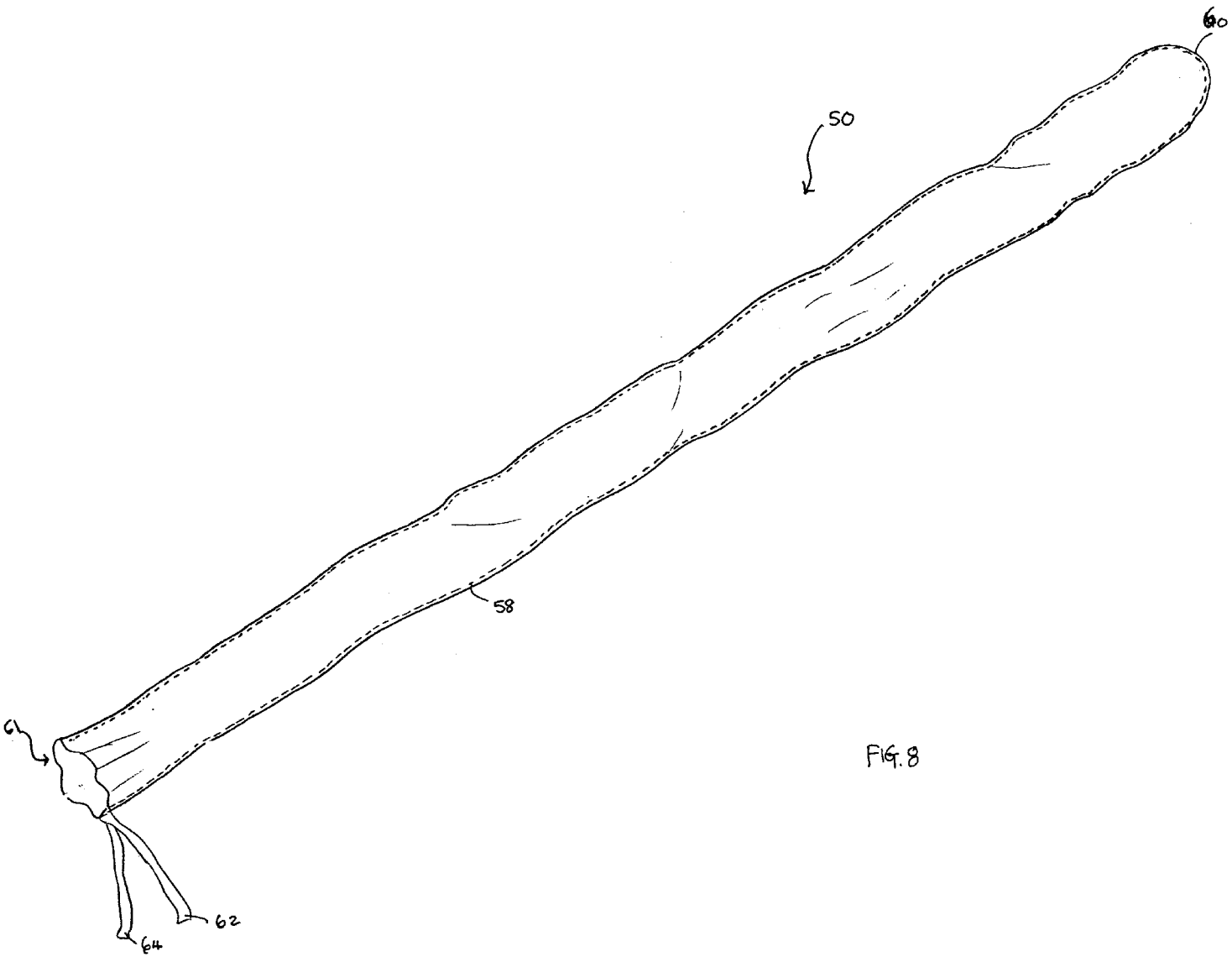
FIG. 8 is a perspective view of the third embodiment of a ski covering of the present invention.
Figure 9:
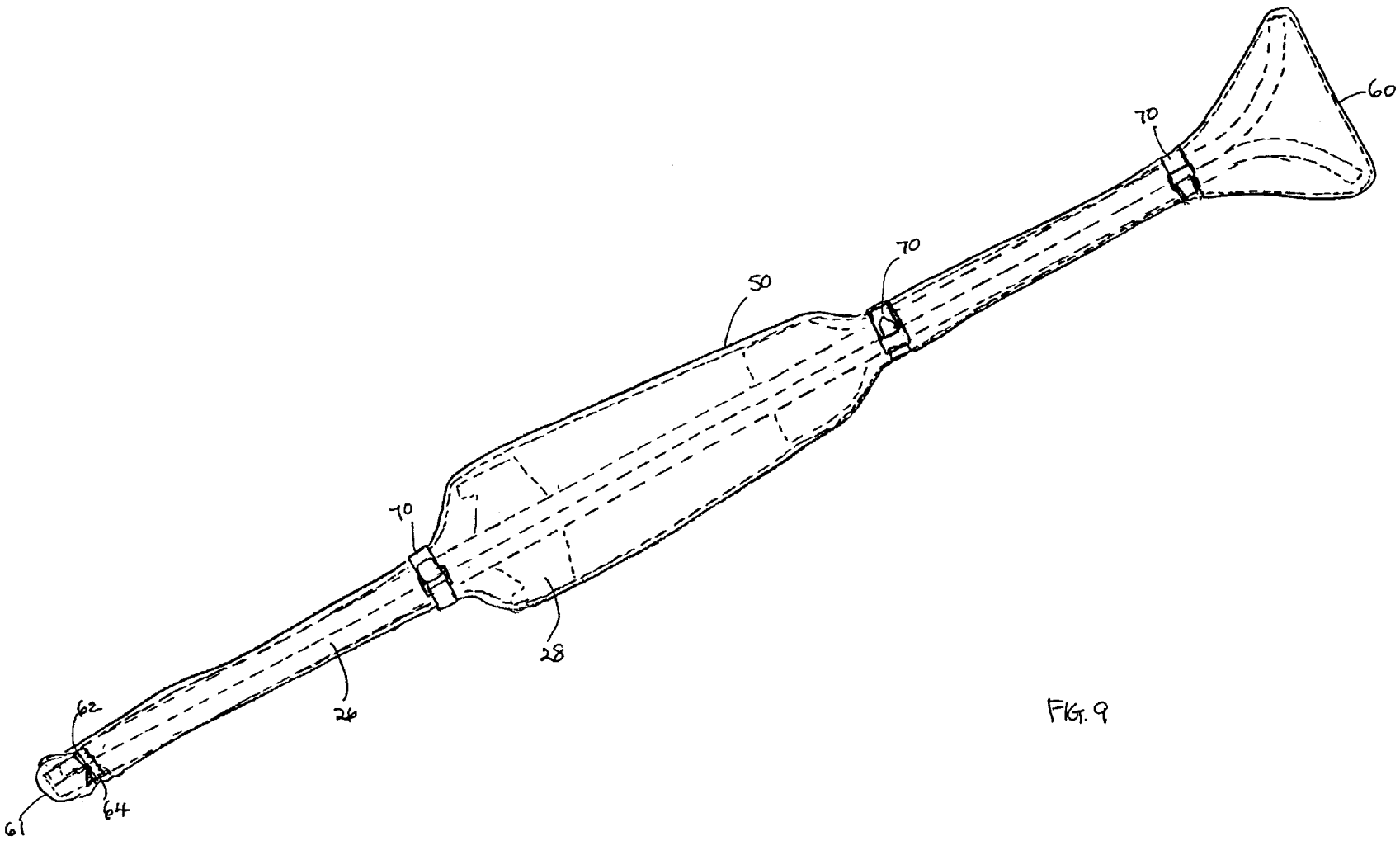
FIG. 9 is a side elevation view of the third embodiment of a ski covering and removable fasteners installed over the ski covering having a pair of skis placed therein.

A third embodiment of the present invention, an elastic covering is provided for use with a pair of skis is illustrated in FIG. 8, and indicated generally as 50. This embodiment of ski covering 50 is similar in construction and utility to snowboard covering 200 illustrated hereinabove. The major differences between the two embodiments lie in the different dimensions of the coverings, 50 and 200, and the number of the removal fasteners provided. Other than these differences, all elements and limitations described for snowboard covering 200 also apply to ski covering 50. As shown in FIG. 8, ski covering 50 is formed as an elongated rectangular bag having a rounded closed end 60 and a straight open end 61. A pair of end closure straps 62, 64 are sewn to the side seam 58 at open end 61. Ski covering 50 is designed to cover any length skis up to at least about seven feet long using a single-size ski covering 50. Ski covering 50 is seven feet long and eight inches wide, although shorter or longer material pieces will also work because of the elasticity of the material from which the coverings are constructed. Three removable fasteners 70 are provided for use together with the ski covering 50. Removable fasteners 70 may be of any type which allow the removable fasteners 70 to hold the ski covering 50 and skis 26 firmly together at any point along their length. In this third embodiment of the present invention, removal fastener 70 is of similar design as removable fastener 230, designed for wrapping around the ski and therefore shorter than removal fasteners 230. Removable fasteners 70 are approximately 11 inches long, but other lengths are within the contemplation of the present invention. After placement of a pair of skis 26, positioned bottom-to-bottom, into ski covering 50, the excess portion of the ski covering 50 extending beyond the skis 26 is folded over upon itself and the end closure straps 62, 64 are wrapped therearound and tied into a knot. Removable fasteners 70 are applied around the skis, one at the tips of the skis, one above and one below the bindings of the skis, as shown in FIG. 9. Removable fasteners 70 maintain the positions of the skis relative to each other. So enclosed, skis 26 are protected for transportation.

While the invention has been illustrated and described in detail in the drawings and foregoing description, the same are to be considered as illustrative and not restrictive in character, it being understood that only the preferred embodiments have been shown and described and that all changes and modifications that come within the spirit of the invention are desired to be protected.

What is claimed is:

1. A protective covering for sporting equipment, comprising:

a first elongated material piece formed from a flexible, elastic, water-permeable fabric, said fabric having a first and second surface;

a second elongated material piece formed from said fabric;

wherein said first and second material pieces are coupled together along three respective sides, thereby forming an opening at a fourth side and defining a cavity;

a plurality of removable fasteners adapted to removably enclose said first and second material pieces and any contents placed therebetween;

wherein said first and second material pieces allow a piece of sporting equipment to be substantially form-fittingly placed within the cavity; and wherein said cavity is stretchable at least 100% lengthwise and at least 50% widthwise.

2. A protective covering for sporting equipment, comprising:

a first elongated material piece formed from a flexible, elastic, water-permeable fabric, said fabric having a first and second surface;

a second elongated material piece formed from said fabric;

wherein said first and second material pieces are coupled together along three respective sides, thereby forming an opening at a fourth side and defining a cavity;

at least one end closure strap coupled to a seam joining said first material piece to said second material piece close to said fourth side;

wherein said first and second material pieces allow a piece of sporting equipment to be substantially form-fittingly placed within the cavity; and wherein said cavity is stretchable at least 100% lengthwise and at least 50% widthwise.

3. The protective covering of claim 2, wherein said end closure strap includes two straps woven from a synthetic fiber.

4. A protective covering for sporting equipment comprising:

a first elongated material piece formed from a flexible, elastic, water-permeable fabric, said fabric having a first and second surface, said first surface having a lower coefficient of friction than said second surface;

a second elongated material piece formed from said fabric;

wherein said first and second material pieces are coupled together along three respective sides, thereby forming an opening at a fourth side and defining a cavity; and wherein said first surface having a lower coefficient of friction faces into said cavity; and a plurality of removable fasteners adapted to removably enclose said first and second material pieces and any contents placed therebetween;

wherein each of said plurality of removable fasteners comprises:

a buckle;

a strap having a first end and a second end, wherein the first end is coupled to one side of said buckle;

a hook material applied to said strap at the second end;

a loop pile material applied to said strap between the first and second ends;

whereby the second end may be adjustably engaged around another side of said buckle and said hook material engaged with said loop pile material.

5. A ski covering comprising:

an elongated bag having an opening and an inside surface defining an interior cavity, said bag formed from a flexible, elastic, water-permeable fabric, said fabric having a low coefficient of friction on both first and second surfaces, said first surface having a lower coefficient of friction than said second surface and oriented with said lower coefficient of friction surface forming said inside surface of said interior cavity; said interior cavity is adapted to receive a pair of skis; and further including at least one removable fastener adapted to removably enclose said bag and any skis placed within said interior cavity; wherein each of said removable fastener includes: a buckle, a strap having a first end and a second end, wherein the first end is coupled to one side of said buckle, a hook material applied to said strap at the second end, a loop pile material applied to said strap between the first and second ends, whereby said second end may be adjustably engaged around another side of said buckle and said hook material engaged with said loop pile material.

6. A ski covering, comprising:

an elongated bag having an opening and an inside surface defining an interior cavity, said bag formed from a flexible, elastic, water-permeable fabric; said bag is approximately seven feet long and eight inches wide when flat; said bag further includes closure straps coupled to said bag close to said opening; said interior cavity is adapted to substantially form-fittingly receive a pair of skis; and said interior cavity is stretchable at least 100% lengthwise and at least 50% widthwise.

7. A snowboard covering comprising:

an elongated bag having an opening and an inside surface defining an interior cavity, said bag formed from a flexible, elastic, water-permeable fabric, said fabric having a low coefficient of friction on both first and second surfaces, said first surface having a lower coefficient of friction than said second surface and oriented with said lower coefficient of friction surface forming said inside surface of said interior cavity; said interior cavity is adapted to receive a snowboard; and further including one removable fastener adapted to removably enclose said bag and said snow board placed within said interior cavity; wherein said removable fastener includes: a buckle, a strap having a first end and a second end, wherein the first end is coupled to one side of said buckle, a hook material applied to said strap at the second end, a loop pile material applied to said strap between the first and second ends, whereby said second end may be adjustably engaged around another side of said buckle and said hook material engaged with said loop pile material.

8. A snowboard covering, comprising:

an elongated bag having an opening and an inside surface defining an interior cavity, said bag formed from a flexible, elastic, water-permeable fabric; said bag is approximately seventy inches long and eight inches wide when flat; said bag further includes means of closing said bag, said means of closing includes two woven nylon straps coupled to said bag close to said opening; said interior cavity is adapted to substantially form-fittingly receive a snowboard; and said interior cavity is stretchable at least 100% lengthwise and at least 50% widthwise.

9. A method of covering a snowboard having bindings thereon, comprising the steps of:

a) providing an elongated bag having an opening, means for closing said opening, an inside surface defining an interior cavity, said bag formed from a flexible, elastic, water-permeable fabric, said fabric having a low coefficient of friction on both first and second surfaces, said first surface having a lower coefficient of friction than said second surface and oriented with said lower coefficient of friction surface forming said inside surface of said interior cavity, said interior cavity is adapted to receive a snowboard;

b) standing said snowboard on one end;

c) inserting said snowboard into said bag through said opening;

d) pulling said bag down over said snowboard through said opening into said interior cavity such that said snowboard are completely enclosed therein;

e) closing the means for closing:

f) providing one removable fastener adapted to removably enclose said snowboard against said bag near said opening; and g) applying said one removable fastener around said bag and said snowboard such that said excess lengths of bag are firmly held and not free to flap during transport.

10. The method of claim 9, wherein step (e) further comprises:

e.1) providing a pair of woven nylon straps, each of the straps being coupled at one end to the opening;

e.2) folding over an end of the bag containing the opening, thereby closing the opening;

e.3) wrapping the nylon straps around the folded-over end of said bag; and e.4) tying the nylon straps into a knot.

11. A method of covering a pair of skis having bindings thereon, comprising the steps of:

a) providing an elongated bag having an opening, means for closing said opening and an inside surface defining an interior cavity, said bag formed from a flexible, elastic, water-permeable fabric, said fabric having a low coefficient of friction on both first and second surfaces, said first surface having a lower coefficient of friction than said second surface and oriented with said lower coefficient of friction surface forming said inside surface of said interior cavity; said interior cavity is adapted to receive a snow board;

b) standing said pair of skis on end;

c) inserting said skis into said bag through said opening;

d) pulling said bag down over said skis through said opening into said interior cavity such that said skis are completely enclosed therein;

e) closing the means for closing;

f) providing at least one removable fastener adapted to removably enclose said skis; and g) applying said at least one removable fastener around said bag and said ski such that said skis are firmly held in contact with one another.

12. The method of claim 11, wherein step (b) further comprises:

b.1) orienting the skis bottom-to-bottom; and b.2) inserting said skis into said bag through said opening and into said interior cavity such that said skis are completely enclosed therein.

13. The method of claim 11, wherein step (e) further comprises:

e.1) providing a pair of woven nylon straps, each of the straps being coupled at one end to the opening;

e.2) folding over an end of the material piece containing the opening, thereby closing the opening;

e.3) wrapping the nylon straps around the folded-over end of the material; and e.4) tying the nylon straps into a knot.

14. The method of claim 11, wherein steps (f) and (g) further comprise:

f) providing three removable fasteners, wherein each removable fastener is adapted to removably enclose ski covering and the skis; and g.1) applying the first removable fastener at a first location on one side of the bindings, such that the material piece and the skis are firmly held in contact with one another at the first location;

g.2) applying the second removable fastener at a second location on another side of the bindings, such that the material piece and the skis are firmly held in contact with one another at the second location; and g.3) applying the third removable fastener at a third location near the tips of said skis, such that the material piece and the skis are firmly held in contact with one another at the third location.

* * * * *